US007372353B2

(12) United States Patent
Wu

(10) Patent No.: US 7,372,353 B2
(45) Date of Patent: May 13, 2008

(54) INVERSE PHASE CONVERTER

(75) Inventor: Chi-Chih Wu, Taipei County (TW)

(73) Assignee: Taiwan Thick-Film Ind. Corp., Taipei County (TW)

( * ) Notice: Subject to any disclaimer, the term of this patent is extended or adjusted under 35 U.S.C. 154(b) by 0 days.

(21) Appl. No.: 11/212,660

(22) Filed: Aug. 29, 2005

(65) Prior Publication Data

US 2007/0046414 A1 Mar. 1, 2007

(51) Int. Cl.
*H01F 27/30* (2006.01)

(52) U.S. Cl. ..... 336/208

(58) Field of Classification Search ..... 336/208
See application file for complete search history.

(56) References Cited

U.S. PATENT DOCUMENTS 4,146,859 A * 3/1979 Quirke ..... 336/110

FOREIGN PATENT DOCUMENTS

JP 10064738 A * 3/1998
JP 10149932 A * 6/1998
TW M267607 U 6/1994

* cited by examiner

*Primary Examiner*—Elvin Enad
*Assistant Examiner*—Joselito Baisa
(74) *Attorney, Agent, or Firm*—Muncy, Geissler, Olds & Lowe, PLLC

(57) ABSTRACT

An inverse phase converter includes a first bobbin, a plurality of second bobbins, a first magnetic core and a second magnetic core. The first magnetic core and the second magnetic cores are overlapped and coupled to form at least one closed magnetic path. The first bobbin has a wire gathering portion to allow a primary coil to be wound horizontally to increase the winding space thereof. The winding direction of the primary coil is normal to the winding direction of a secondary coil wound on the second bobbin. The temperature generated by the primary coil is lower, and the length of the magnetic cores may be shortened.

8 Claims, 6 Drawing Sheets

INVERSE PHASE CONVERTER

FIELD OF THE INVENTION

The present invention relates to an inverse phase converter and particularly to an inverse phase converter for generating a plurality of high voltage sides to supply equal number of cold cathode fluorescent lamps (CCFLs).

BACKGROUND OF THE INVENTION

The conventional inverse phase converter has a magnetic core located in a bobbin. The bobbin is wound with coils of the same or different diameters to become a first side coil and a second side coil. The magnetic core wound with the first side coil and the second side coil is encased in shell to become an induction coil inverse phase converter. The present liquid crystal display (LCD) has a back light module which generates light through CCFLs that are compact and powerful. The CCFLs are driven by high voltage electric power. Hence the CCFLs require the inverse phase converter to generate light to serve as the light source of the LCD.

As large display device has gradually become the mainstream of the market, a plurality of CCFLs are needed to provide light and achieve a desirable display effect. As a result, the demand of supporting multiple CCFLs through a single inverse phase converter increases. R.O.C. patent No. M267607 discloses an inverse phase converter that has multiple coils winding on a primary side winding zone to generate more magnetic sheaves so that high voltage may be generated on a secondary side winding zone to supply electricity required by one or more CCFLs. Its coils are wound on a hollow bobbin with two spacers dividing the bobbin into three zones. The three zones include a pair of secondary side winding zones on two sides and a primary side winding zone in the middle.

In order to generate the high voltage, the winding number of coils on the primary side winding zone must be increased. But the two sides of the primary side winding zone are occupied by the second side winding zones. Hence the winding coil can only be stacked upwards. This creates difficulty of installation on the circuit board. Moreover, the inverse phase converter could be easily overheated. To reduce the heat generated by the winding coil, the diameter of the bobbin on the primary side winding zone must be larger. As the winding space of the primary side winding zone is restricted, the number of coils that can be wound decreases. This affects the voltage output of the inverse phase converter. As a result, the number of installable CCFLs also is limited.

Moreover, to increase the number of the winding coil by increasing the length of the primary side winding zone requires a longer magnetic core. This creates quality problem of magnetic core fabrication. The performance of the inverse phase converter also is impacted.

SUMMARY OF THE INVENTION

Therefore the primary object of the present invention is to solve the aforesaid disadvantages. The invention aims to wind a primary coil horizontally on a first bobbin so that the thickness of the inverse phase converter is not affected after the winding is finished regardless the diameter of the primary coil. The temperature generated by the primary coil also can be reduced. The first bobbin is overlapped with a second bobbin so that the length of the magnetic core can be shortened. The inverse phase converter according to the invention includes:

a first magnetic core which has at least one jutting common end and one jutting individual end;

a first bobbin which is run through by the common end and interposed between the individual ends, and wound horizontally by a primary coil;

at least one second magnetic core coupled with the first magnetic core to form at least one closed magnetic path; and at least one second bobbin which is overlapped with the first bobbin and run through by the second magnetic core, and wound by a secondary coil which is normal to the winding direction of the primary coil.

Another object of the invention is to divide the second bobbin by spacers to form a plurality of winding zones to prevent the secondary coils wound on the second bobbin from loosening off or generating jump sparks.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
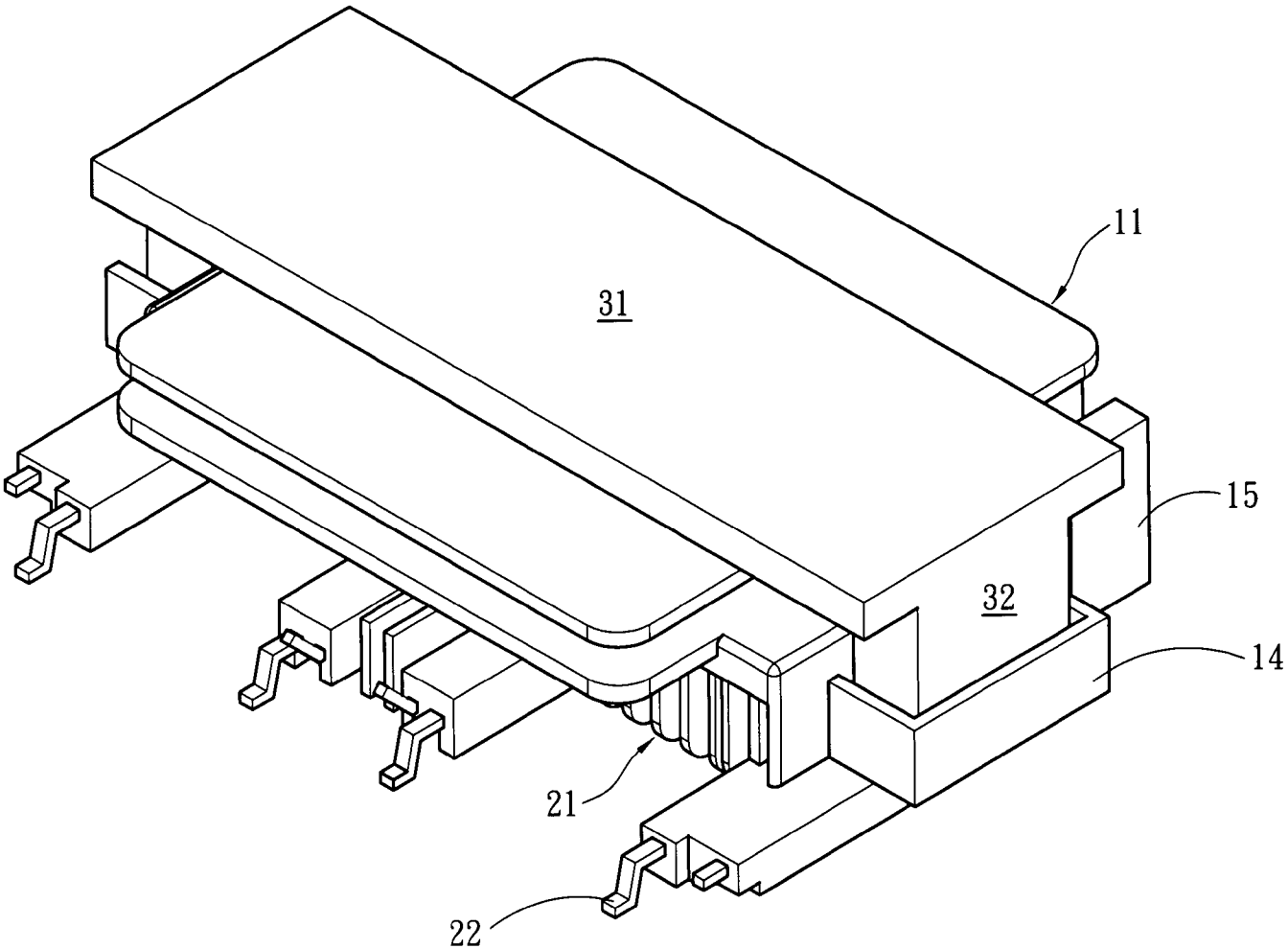
FIG. 1 is a perspective view of an embodiment of the present invention.
Figure 2:
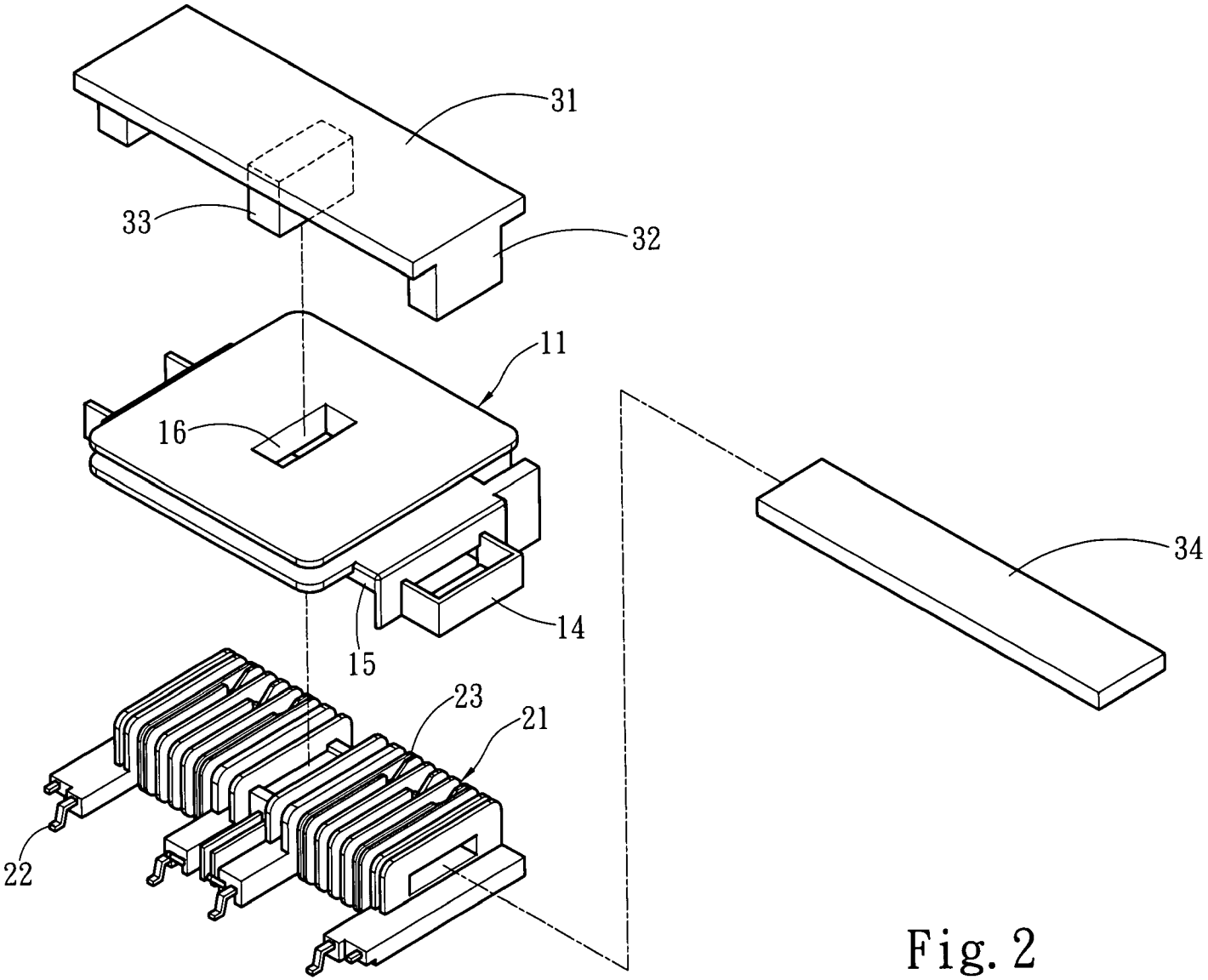
FIG. 2 is an exploded view of an embodiment of the present invention.

Please refer to FIGS. 1 and 2 for an embodiment of the invention. The inverse phase converter includes a first magnetic core 31 which has one or more jutting individual end 32 and one jutting common end 33. The common end 33 runs through an opening 16 formed on a first bobbin 11. The first bobbin 11 is located between the individual ends 32 and extended to form a holding portion 15. The holding portion 15 has a coupling portion 14 to anchor the individual end 32.

Figure 3:
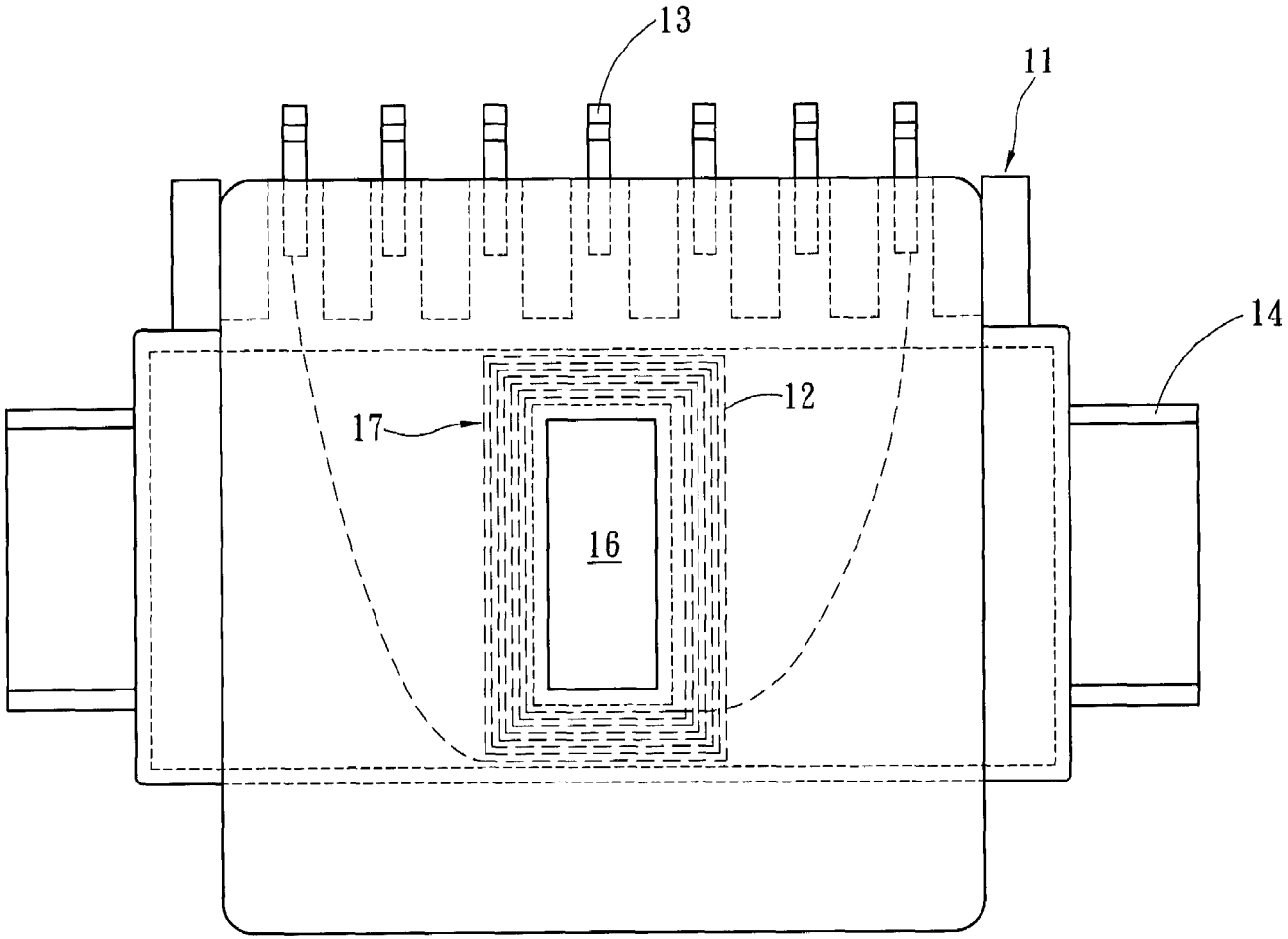
FIG. 3 is a schematic view of an embodiment of the present invention showing the first bobbin and the primary coil.
Figure 4:
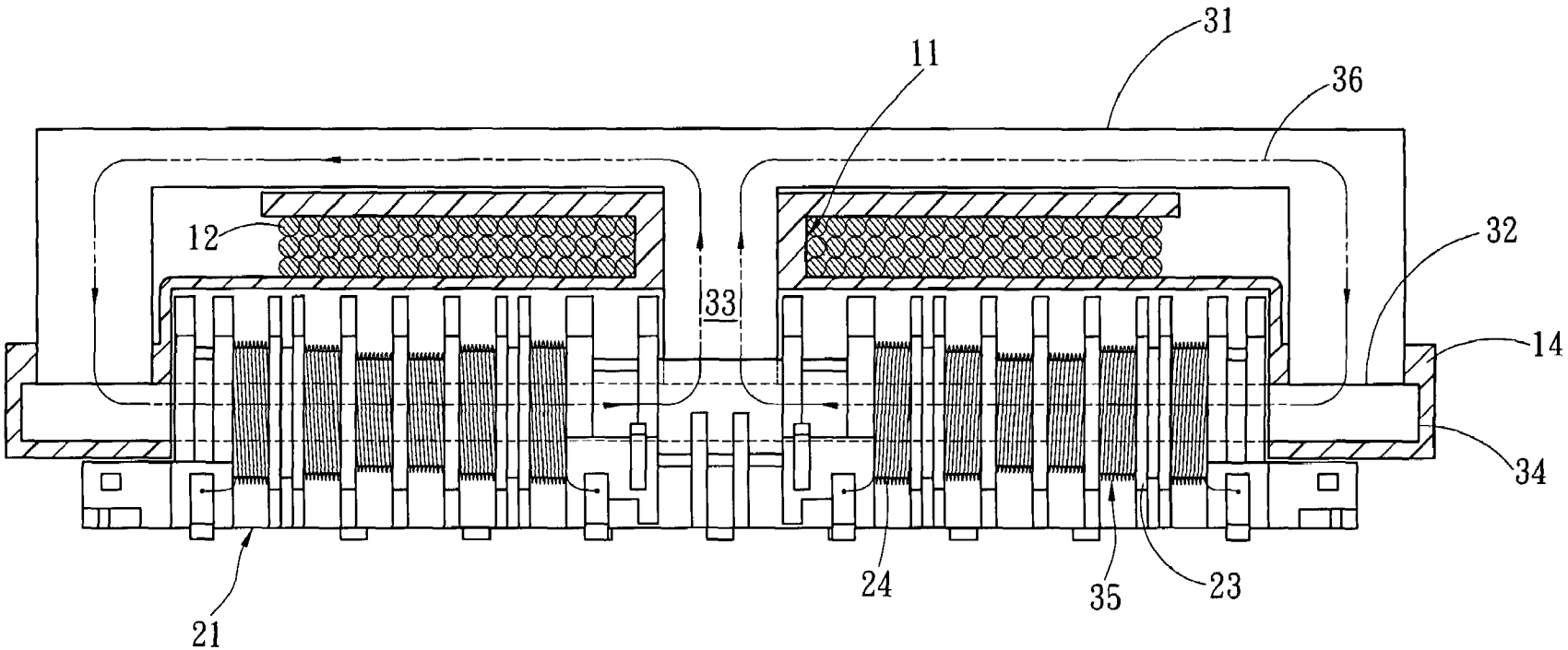
FIG. 4 is a cross section of an embodiment of the present invention.

Refer to FIGS. 3 and 4 for the first bobbin and primary coil, and the cross section of an embodiment of the invention. The first bobbin 11 has a plurality of first terminals 13, and an independent wire gathering portion 17 to increase the space of a primary coil 12. Winding of the primary coil 12 starts on one end of the first terminal 13, then is threaded to the wire gathering portion 17 and wound continuously, and finally is wound on another end of the first terminal 13. The common end 33 of the first magnetic core 31 runs through the wire gathering portion 17 and is connected to a second magnetic core 34. The second magnetic core 34 is connected to the common end 33 of the first magnetic core 31 on the coupling portion 14 thereby the first magnetic core 31 and the second magnetic core 34 are coupled to form at least one closed magnetic path 36 (referring to FIG. 4).

Referring to FIGS. 2 and 4, the second magnetic core 34 runs through at least one second bobbin 21. The second bobbin 21 is covered by the holding portion 15 of the first bobbin 11. Moreover, the second bobbin 21 is divided by spacers 23 to form a plurality of winding zones 35. The winding zones 35 allow a secondary coil 24 to be wound thereon separately to prevent multiple winding coils of the secondary coil 21 from loosening off and generating jump sparks. The second bobbin 21 has a plurality of second terminals 22 to output electricity. The winding direction of the secondary coil 24 is normal to the winding direction of the primary coil 12.

The first bobbin 11 and the second bobbin 21 form the closed magnetic path 36 by coupling of the first magnetic core 31 and the second magnetic core 34. In this embodiment, the first magnetic core 31 may be formed in an I-shape according to the profile of the first bobbin 11. The second magnetic core 34 may be formed in an I-shape according to the profile of the second bobbin 21.

Figure 5:
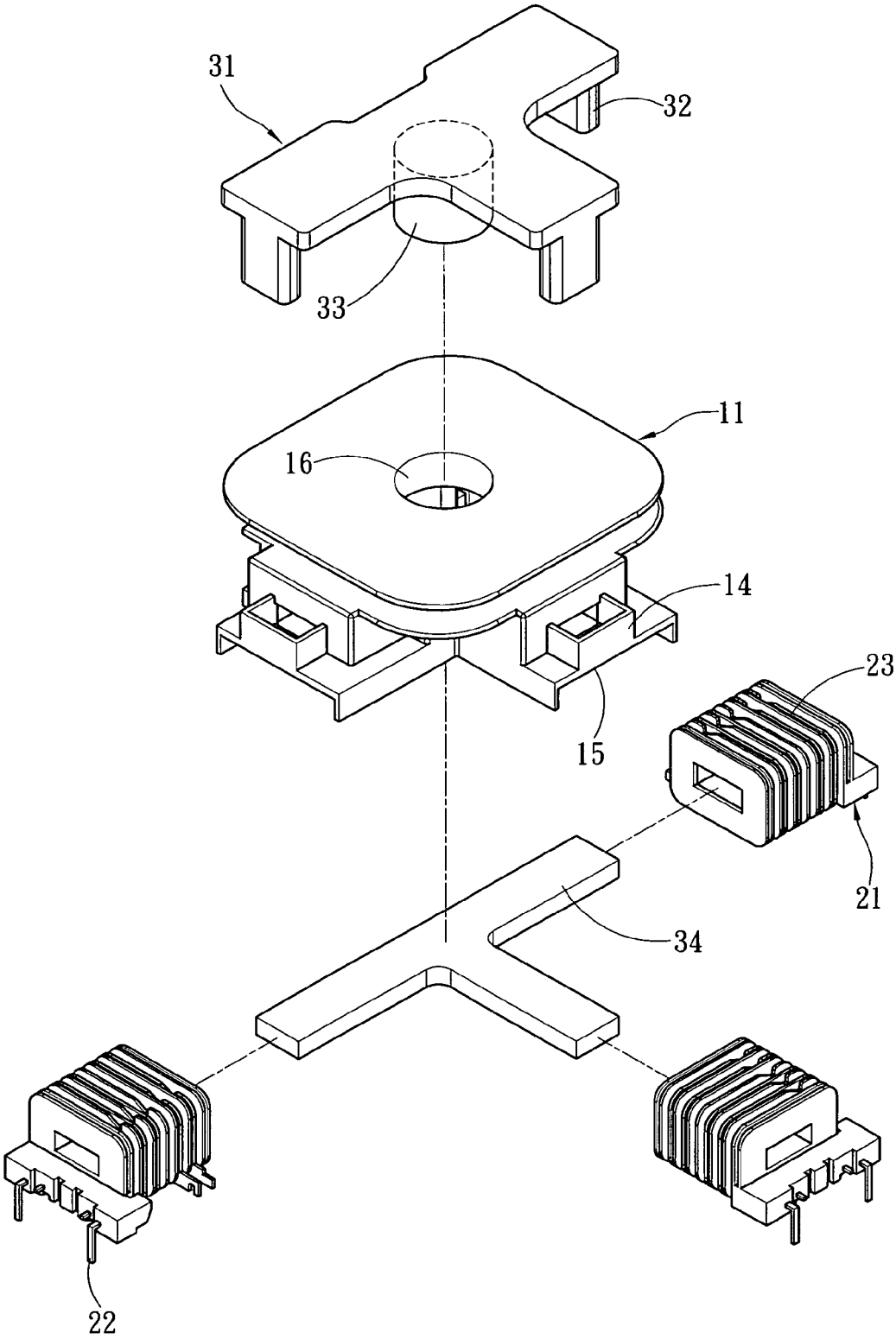
FIG. 5 is an exploded view of a second embodiment of the present invention.

Refer to FIG. 5 for an exploded view of a second embodiment of the invention. The first magnetic core 31 is formed in a T-shape according to the profile of the first bobbin 11. The T-shaped magnetic core has three individual ends 32 to be connected to three coupling portions 14 of the second magnetic core 34. Moreover, the T-shaped magnetic core has a common end 33 to run through the first bobbin 11 and couple with the second magnetic core 34. The second magnetic core 34 also is formed in a T-shape according to the profile of three second bobbins 21.

Figure 6:
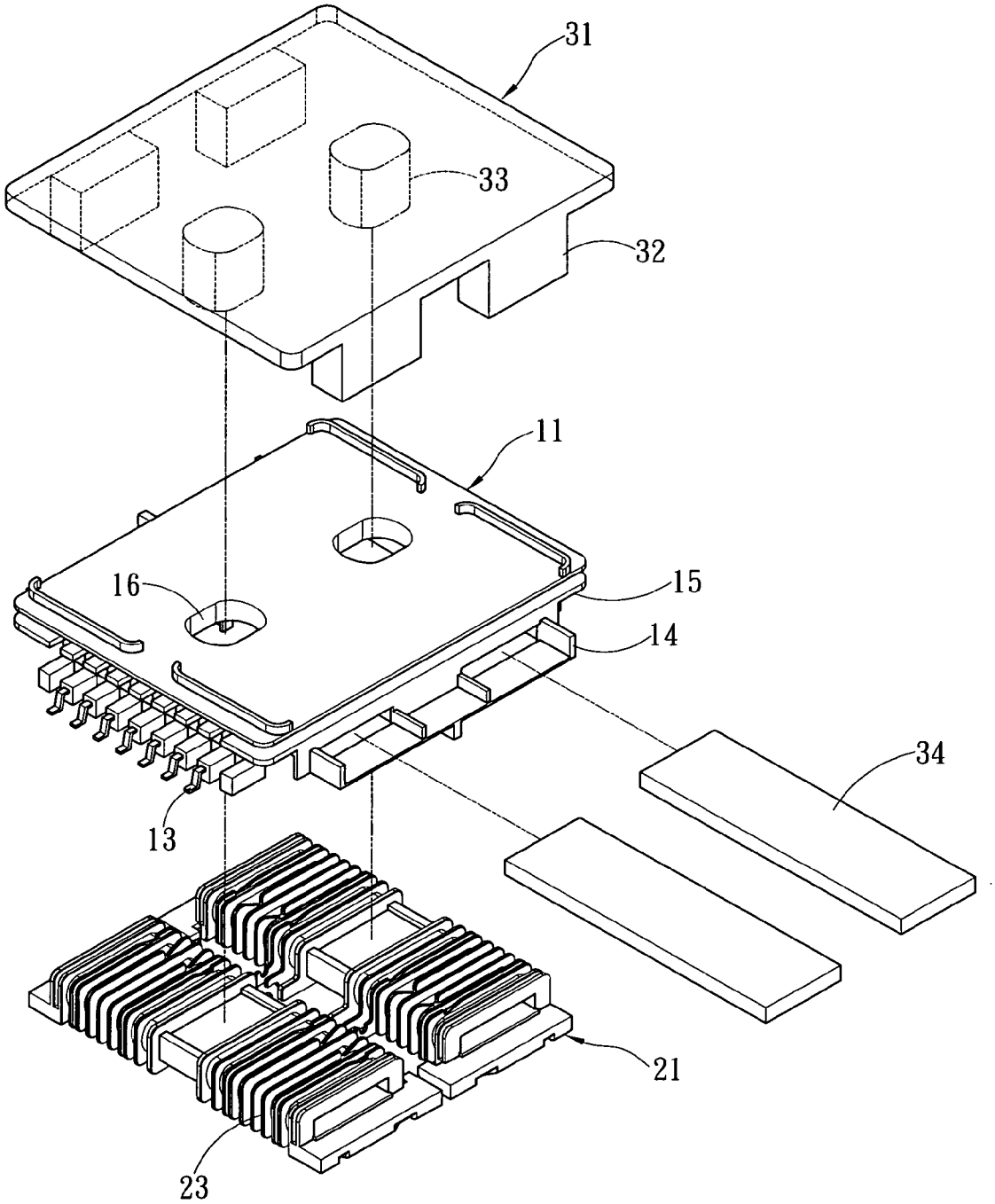
FIG. 6 is an exploded view of a third embodiment of the present invention.

Refer to FIG. 6 for an exploded view of a third embodiment of the invention. The first magnetic core 31 is formed in a square according to the profile of the first bobbin 11. The square magnetic core has four individual ends 32 to be connected to four coupling portions 14 of the second magnetic core 34. Moreover, the square magnetic core has two common ends 33 to run through the first bobbin 11 and couple with two second magnetic cores 34. The two second magnetic cores 34 are formed respectively in an I-shape according to the profile of four second bobbins 21.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An inverse phase converter, comprising:

a first magnetic core having at least one jutting common end and at least one jutting individual end;

a first bobbin which is run through by the common end and interposed between the individual end and wound horizontally by a primary coil;

at least one second magnetic core coupling with the first magnetic core to form at least one closed magnetic path; and at least one second bobbin which is overlapped with the first bobbin and run through by the second magnetic core but without being run through by the first magnetic core, and wound by a secondary coil which is normal to the winding direction of the primary coil.

2. The inverse phase converter of claim 1, wherein the first magnetic core is formed in an I-shape.

3. The inverse phase converter of claim 1, wherein the second magnetic core is formed in an I-shape.

4. The inverse phase converter of claim 1, wherein the second bobbin is divided by spacers to form a plurality of winding zones.

5. The inverse phase converter of claim 1, wherein the first bobbin is extended to form a holding portion.

6. The inverse phase converter of claim 5, wherein the holding portion has a coupling portion to anchor the individual end.

7. The inverse phase converter of claim 1, wherein the second bobbin has a plurality of second terminals connecting to loads.

8. The inverse phase converter of claim 7, wherein the loads are cold cathode fluorescent lamps.

* * * * *